US009045976B2

(12) United States Patent
Hallundbaek

(10) Patent No.: US 9,045,976 B2
(45) Date of Patent: Jun. 2, 2015

(54) PUMPING SYSTEM

(75) Inventor: Jorgen Hallundbaek, Graested (DK)

(73) Assignee: WELLTEC A/S, Allerød (DK)

( * ) Notice: Subject to any disclaimer, the term of this patent is extended or adjusted under 35 U.S.C. 154(b) by 248 days.

(21) Appl. No.: 13/695,469

(22) PCT Filed: Apr. 29, 2011

(86) PCT No.: PCT/EP2011/056827
§ 371 (c)(1),
(2), (4) Date: Oct. 31, 2012

(87) PCT Pub. No.: WO2011/135069
PCT Pub. Date: Nov. 3, 2011

(65) Prior Publication Data

US 2013/0043023 A1 Feb. 21, 2013

(30) Foreign Application Priority Data

Apr. 29, 2010 (EP) ..... 10161453

(51) Int. Cl.
*E21B 43/12* (2006.01)
*F04B 47/06* (2006.01)

(52) U.S. Cl.
CPC ..... *E21B 43/128* (2013.01); *F04B 47/06* (2013.01)

(58) Field of Classification Search
CPC ..... E21B 43/128
USPC ..... 166/66.4, 68, 105, 385
See application file for complete search history.

(56) References Cited

U.S. PATENT DOCUMENTS

| | | | | | |
|---|---|---|---|---|---|
| 2,032,000 | A | * | 2/1936 | Wert et al. | 417/414 |
| 2,431,492 | A | * | 11/1947 | Truman | 417/271 |
| 2,972,955 | A | * | 2/1961 | Richter et al. | 91/486 |
| 3,486,454 | A | * | 12/1969 | Tuzson | 417/271 |
| 3,589,838 | A | * | 6/1971 | Tuzson | 417/339 |
| 4,425,087 | A | * | 1/1984 | Gould | 417/414 |
| 4,476,923 | A | * | 10/1984 | Walling | 166/66.4 |
| 4,536,137 | A | | 8/1985 | Bookout et al. | |

(Continued)

FOREIGN PATENT DOCUMENTS

CA 2 450 707 A1 12/2002

(Continued)

OTHER PUBLICATIONS

International Preliminary Report on Patentability for corresponding International Application No. PCT/EP2011/056827, mailed Nov. 8, 2012.
International Search Report for PCT/EP2011/056827, mailed Jun. 6, 2011.
Written Opinion of the International Searching Authority for PCT/EP2011/056827, mailed Jun. 6, 2011.
Office Action mailed Oct. 10, 2014 in Chinese Application No. 201180021440.X, with English Translation (12 pages).

*Primary Examiner* — Kenneth L Thompson
(74) *Attorney, Agent, or Firm* — Nixon & Vanderhye P.C.

(57) ABSTRACT

The present invention relates to a wellbore pumping system submerged into a wellbore for unloading liquid from a wellbore comprising well fluid, such as gas, having a wellbore pressure, comprising a pump having an inlet and an outlet, a tubing fluidly connected with the outlet of the pump, and a driving unit connected with and powered by a cable, such as a wireline, and having a rotatable drive shaft for driving the pump, wherein the pump is a reciprocating pump comprising at least one pumping unit having a first moving member displaceable in a housing for sucking well fluid into and out of a first chamber. Furthermore, the invention relates to a wellbore pumping method.

27 Claims, 4 Drawing Sheets

(56) References Cited

U.S. PATENT DOCUMENTS

| | | | | |
|---|---|---|---|---|
| 5,261,791 | A | 11/1993 | Goguen | |
| 8,511,390 | B2 * | 8/2013 | Coyle et al. | 166/369 |
| 2002/0189805 | A1 | 12/2002 | Howard | |
| 2006/0124298 | A1 | 6/2006 | Geier | |
| 2008/0080991 | A1 * | 4/2008 | Yuratich et al. | 417/390 |

FOREIGN PATENT DOCUMENTS

| | | | |
|---|---|---|---|
| CN | 1203654 | A | 12/1998 |
| EP | 0 310 254 | A2 | 4/1989 |
| RU | 1120442 | A * | 10/1984 |
| SU | 1120442 | A | 10/1983 |
| WO | WO 93/18302 | A1 | 9/1993 |

* cited by examiner

PUMPING SYSTEM

This application is the U.S. national phase of International Application No. PCT/EP2011/056827, filed 29 Apr. 2011, which designated the U.S. and claims priority to Europe Application No. 10161453.5 filed 29 Apr. 2010, the entire contents of each of which are hereby incorporated by reference.

FIELD OF THE INVENTION

The present invention relates to a wellbore pumping system submerged into a wellbore for unloading liquid from a wellbore comprising well fluid, such as gas, having a wellbore pressure, comprising a pump having an inlet and an outlet, a tubing fluidly connected with the outlet of the pump, and a driving unit connected with and powered by a cable, such as a wireline, and having a rotatable drive shaft for driving the pump, wherein the pump is a reciprocating pump comprising at least one pumping unit having a first moving member displaceable in a housing for sucking well fluid into and out of a first chamber. Furthermore, the invention relates to a wellbore pumping method.

BACKGROUND ART

During gas production, water particles may be present in a well fluid or be produced while being transported up through the wellbore or borehole, and some of these water particles may condense on the inner face of the wellbore and subsequently flow along the inner face down to the bottom of the wellbore. In this way, the water accumulates at the bottom of the well and will subsequently block the passage of gas from the formation into the wellbore.

When the water has reduced or even stopped the passage of gas from the wellbore, a pump is connected to a drill pipe and lowered into the well in order to pump the water up through the drill pipe. However, the existing pumping solutions are very large and require the presence of a drill pipe or similar solutions.

DESCRIPTION OF THE INVENTION

It is an object of the present invention to wholly or partly overcome the above disadvantages and drawbacks of the prior art. More specifically, it is an object to provide a pumping system which is more simple and easier to submerge into a wellbore without using drill pipes or coil tubing to pump water up from the well.

The above objects, together with numerous other objects, advantages, and features, which will become evident from the below description, are accomplished by a solution in accordance with the present invention by a wellbore pumping system submerged into a wellbore for unloading liquid from a wellbore comprising well fluid such as gas, having a wellbore pressure, comprising:

- a pump having an inlet and an outlet,
- a tubing fluidly connected with the outlet of the pump, and
- a driving unit connected with and powered by a cable, such as a wireline, and having a rotatable drive shaft for driving the pump, wherein the pump is a reciprocating pump comprising at least one pumping unit having a first moving member displaceable in a housing for sucking well fluid into and out of a first chamber.

The wellbore pumping system is a wellbore liquid unloading pumping system for unloading liquid, such as water, from a bottom of a wellbore comprising well fluid, such as gas, having a wellbore pressure to a location away from the wellbore, and wherein the tubing is fluidly connected with the outlet of the pump and extended to the location. The location may be a rig, a vessel or the water above the well head. Furthermore, the pump is a submersible pump and the driving unit is a submersible driving unit.

In one embodiment, the first moving member may divide the housing into the first chamber and a second chamber.

In another embodiment, the system may comprise a one-way valve arranged between the inlet and the first chamber, and a second one-way valve arranged between the outlet and the first chamber, enabling liquid to be sucked into the first chamber and subsequently forced out through the second one-way valve by displacing the moving member.

The wellbore pumping system may further comprise a compensator device comprising a compensator chamber having a compensator moving member displaceable in the compensator chamber and dividing the compensator chamber into a first chamber section and a second chamber section, wherein the first chamber section is in fluid communication with the well fluid, and the second chamber of the reciprocating pump is in fluid communication with the second chamber section.

The purpose of this is to create a pressure equilibrium between the two chambers to ensure that dirty liquid from the wellbore does not leak into the clean side of the pump.

In one embodiment, the compensator moving member may be a piston.

Also, the compensator device may comprise at least one flexible element arranged in the first chamber section forcing the compensator moving member towards the pump.

Additionally, the compensator moving member may have a circumferential sealing means.

Further, a wellbore pumping system according to the invention may have a system housing having openings into which a screen or filter may be arranged preventing scales or other particles from entering the compensator device or the pump and deteriorating their function.

Furthermore, the first chamber may be filled with liquid during pumping of the liquid, such as water, and the second chamber may be filled with a second liquid.

Additionally, the second liquid may be a dielectric fluid, such as mineral oil, castor oil, Polychlorinated biphenyls, etc.

In one embodiment, the tubing may be made from a non-metallic material.

In another embodiment, the tubing may be made from a material more flexible than iron or steel.

In yet another embodiment, the tubing may be made from plastic, syntactic or natural rubber or a composite.

Moreover the pumping unit may be surrounded by a cavity filled with the second liquid and be in fluid communication with the second chamber of the pumping unit.

Furthermore, the pump may have a plurality of pumping units, and the moving members may be arranged so that when one moving member moves in one direction, another moving member moves in an opposite direction.

Additionally, the reciprocating pump may be a radial or axial pump.

In one embodiment of the invention, a first moving member may displace a first volume of liquid when moved in one direction, and a second moving member may displace a second volume of liquid when moved in another direction opposite the first direction, wherein the first and the second volumes are substantially equal in size.

In another embodiment, a first moving member may displace a first volume of liquid when moved in one direction, and two or more moving members may displace a second volume of liquid when moved in one direction, wherein the first and the second volumes are substantially equal in size.

The wellbore pumping system may further comprise a control unit for activating the pump.

Furthermore, the control unit may have a measuring unit for measuring the power used by the driving unit for driving the pump.

If the measuring unit measures that the driving unit uses less power than a predetermined value, the pump is stopped again. The value is set at the power used by the driving unit when it drives a pump which pumps up no or only a small amount of liquid. In this way, it is possible to save power when no or only a small amount of liquid is present in the wellbore. The system waits a predetermined period of time and then reactivates the pump while measuring the power. When the system has activated the pump accordingly at the predetermined time interval a predetermined number of times, the time interval is extended In an embodiment of the invention, the moving member may be a solid or a flexible member/plate/disk.

Furthermore, the number of moving members may be at least two.

In addition, the measuring means may be used for detecting the level of energy consumption during the pumping activity.

Moreover, the control unit may comprise a receiving means for receiving the level of the energy consumption or power needed for driving the pump as well as a calculator unit for comparing the consumption with a predetermined minor value.

Furthermore, the reciprocating pump may be a diaphragm pump, a piston pump or a plunger pump.

Additionally, a filter device may be placed in front of or be an integrated part of the inlet.

In addition, the pump may be activated when a predetermined period of time has passed since the last stop of the pump.

This period of time may increase from activation to activation or when a predetermined number of activation attempts have been made if the energy consumption or power is lower than the predetermined value.

Furthermore, the time period may be between 5 minutes and 1 month.

The wellbore pumping system may further comprise a fixation means for fixating the pump inside the wellbore.

Moreover, the driving unit may comprise a starting means which during activation of the pump may reduce a torque delivered to the drive shaft driving the pump.

Such a starting means is also called "soft starters" and is used in combination with AC electrical motors.

Moreover, the driving unit may be an electrical motor or a hydraulic motor.

The wellbore pumping system may further comprise a driving tool for moving the pumping system inside the wellbore.

Additionally, the driving tool may be a downhole tractor.

In one embodiment of the invention, the drive shaft may be connected with rotating cams connected with the first moving member producing reciprocating motion.

Also, the drive shaft may drive several pumps.

In one embodiment, the tubing may have a cross-sectional width being less than 25% of an inner diameter of the wellbore or a casing in the wellbore, preferably less than 10% of the inner diameter and more preferably less than 5% of the inner diameter.

Further, the wellbore system may comprise a wellbore pumping system according to the invention, and may comprise a driving tool for moving itself and the wellbore pumping system inside the wellbore.

The present invention furthermore relates to a method comprising the steps of:

- entering a wellbore pumping system according to the invention,
- activating the pump,
- measuring the power used by the driving unit for driving the pump,
- determining whether the power is higher than a predetermined value, and
- stopping the pump when the power is lower than the predetermined value.

Finally, the invention relates to a method further comprising the step of reactivating the pump after a predetermined period of time.

BRIEF DESCRIPTION OF THE DRAWINGS

The invention and its many advantages will be described in further detail below with reference to the accompanying schematic drawings, which for the purpose of illustration show some non-limiting embodiments and in which.

DETAILED DESCRIPTION OF THE INVENTION

Figure 1:
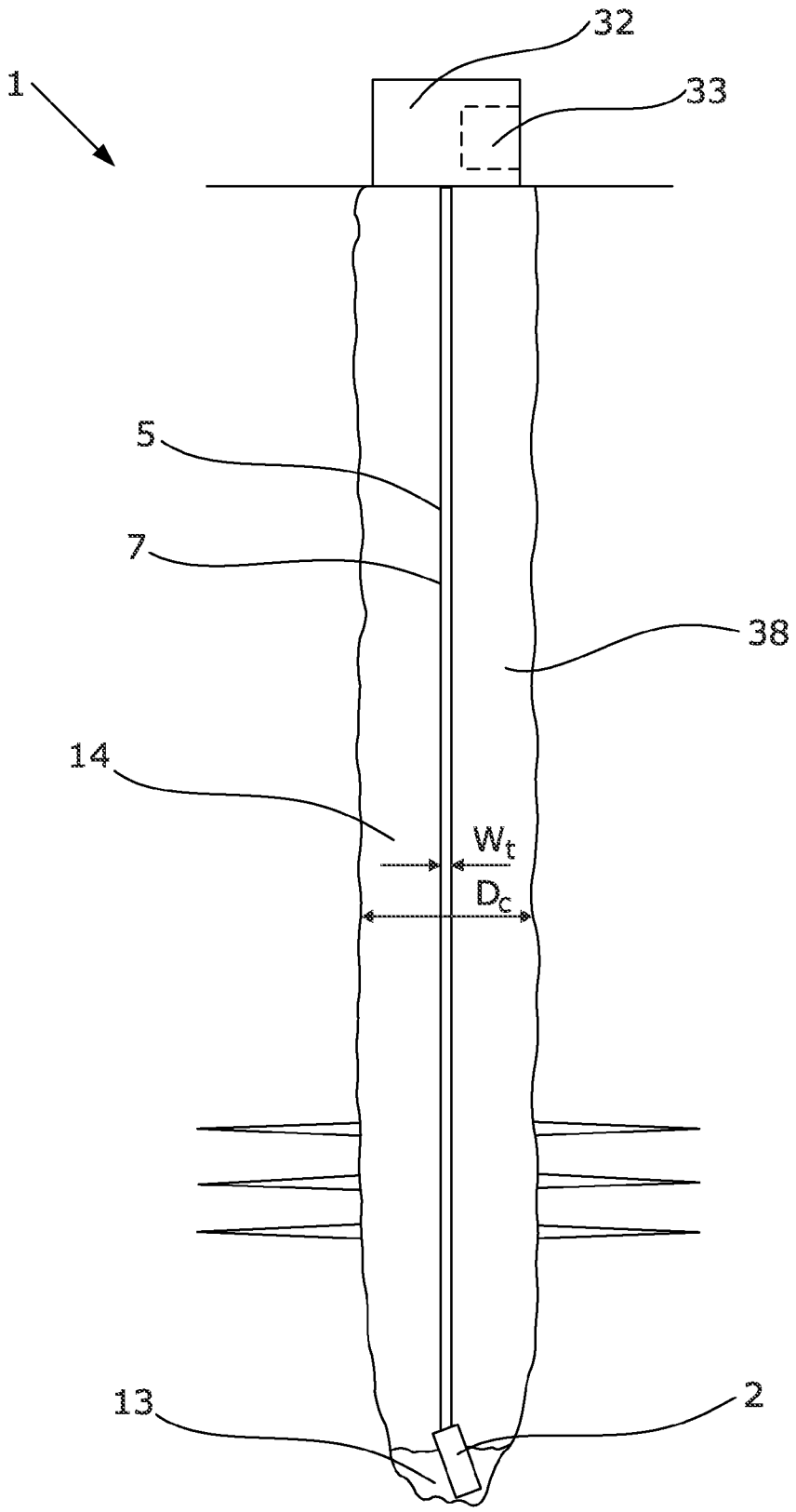
FIG. 1 shows a wellbore pumping system in a wellbore.

FIG. 1 shows a wellbore pumping system 1 according to the invention submerged into a wellbore 38 for pumping liquid 13 from the wellbore to above surface. The borehole comprises well fluid 14, such as gas, at a certain wellbore pressure P. During gas production, water particles may be present in the well fluid or be produced while being transported up through the wellbore or borehole. When passing inside the wellbore, some of these water particles condense on the inner face of the wellbore and subsequently flow along the inner face down to the bottom of the wellbore. The gas may also precipitate other liquids than water.

In order to pump the water up from the bottom of the well, the wellbore pumping system 1 is submerged into the well by means of a wireline, as shown in FIG. 1. The wellbore pumping system 1 comprises a small flexible tubing 5 in which the water flows while being pumped to above surface. The tubing has a cross-sectional width $w_t$ being less than 25% of an inner diameter Dc of the wellbore or a casing 39. The cross-sectional width $w_t$ of the tubing is less than 25% of the inner diameter $D_c$ of the wellbore 38 or the casing 39 in the wellbore, preferably less than 10% of the inner diameter $D_c$ and more preferably less than 5% of the inner diameter $D_c$, and even more preferably less than 2% of the inner diameter.

Figure 2:
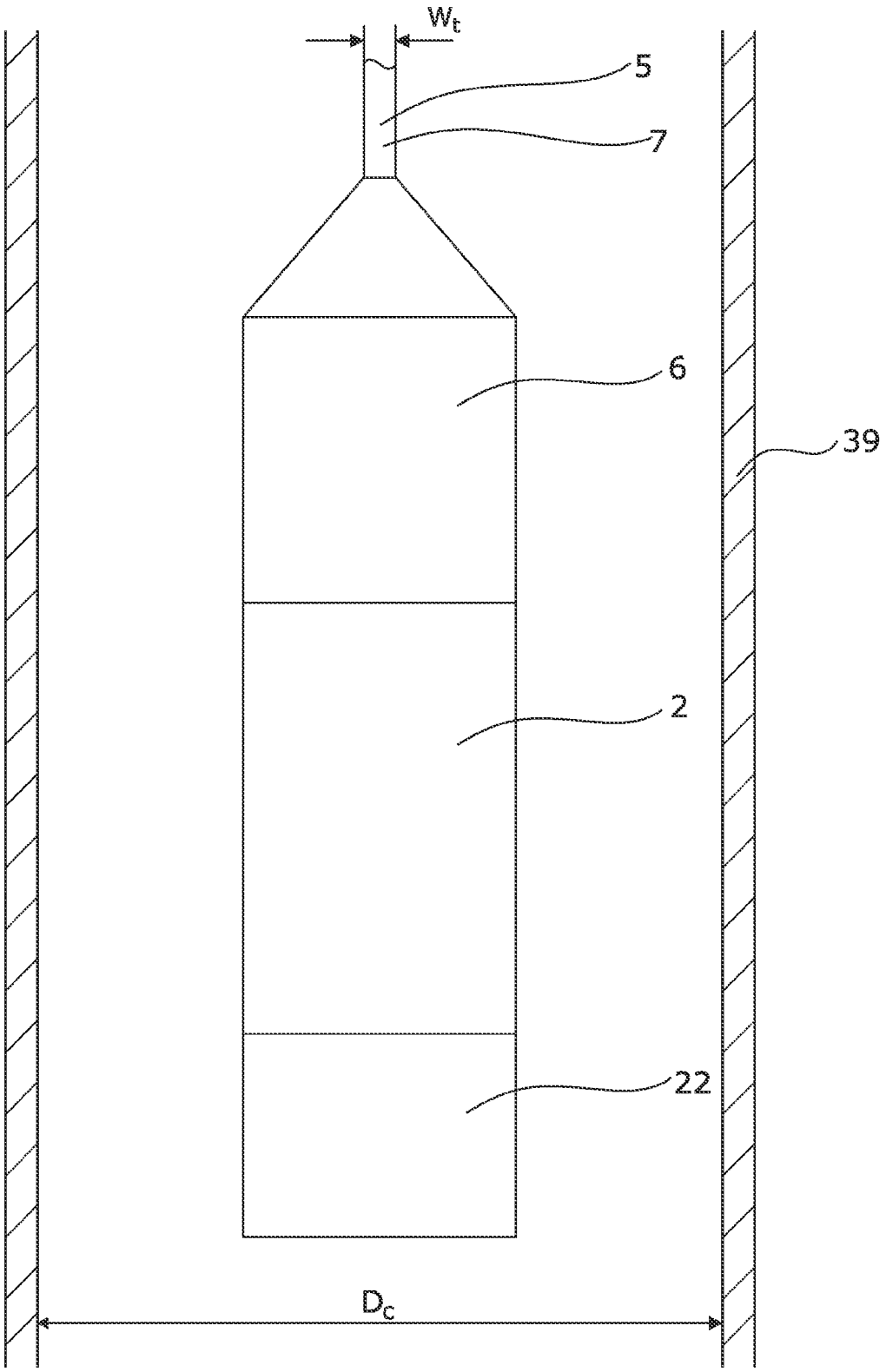
FIG. 2 shows the wellbore pumping system seen from the side.

The wellbore pumping system 1 comprises a system housing 37 comprising a pump 2 for pumping liquid 13 to above surface or to another place, and the wellbore pumping system furthermore comprises a driving unit 6 used to activate and drive the pump 2, as shown in FIG. 2. The driving unit 6 is connected to and powered by a cable 7 which may be part of the tubing 5 or a separate cable, such as a wireline. Furthermore, the wellbore pumping system 1 comprises a compensator 22 being a compensator device 22 to compensate for the high well pressure at the bottom of the well. The compensator device 22 supplies the pump 2 with fluid if the well pressure surrounding the pump increases, ensuring that the walls of the pump do not collapse. If the pressure drops again, the compensator device 22 is capable of accumulating the fluid inside the pump 2 to ensure that the pump does not bulge outwards.

The compensator device 22 allows for the pumping system 1 to have thin walls, causing it to be less expensive to produce. A thin wall construction weighs less than prior art pumping systems and thus does not put as much stress on the tubing as heavier prior art systems, making it possible to use a smaller tubing.

Figure 3:
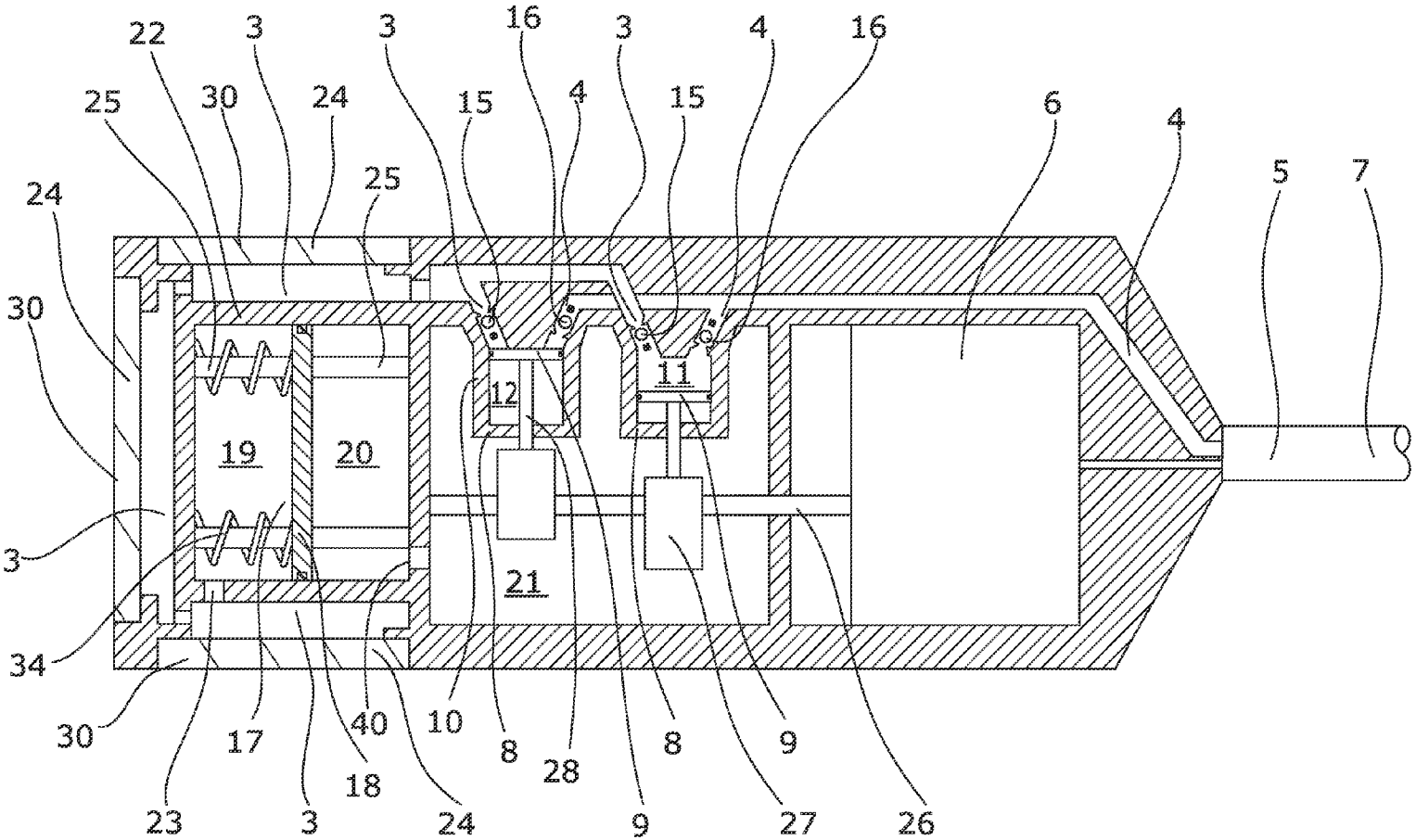
FIG. 3 shows a partly cross-sectional view along the longitudinal direction of the system.

As shown in FIG. 3, the pump 2 has an inlet 3 for letting liquid 13 into the pump 2 and an outlet 4 which is fluidly connected to the tubing 5 used for transporting the liquid 13. The pump 2 is a reciprocating pump since this type of pump is a simple pump which is also capable of pumping small amounts of liquid. Thus, the pumping system 1 can be used as a permanent system arranged inside the well during gas production, eliminating the need for an additional larger pumping system.

The pump 2 is a radial piston pump comprising two pumping units 8 having a first moving member 9, such as a piston, being displaceable in a housing 10 and dividing the housing into a first chamber 11 and a second chamber 12. The liquid 13 is pumped into the first chamber 11 from the wellbore, further out through the outlet 4 and into the tubing 5. Thus, the first chamber 11 is situated on the "dirty" side of the moving member 9, and the piston 8 is capable of pushing the dirt in front of itself when moving towards the inlet 3. In this way, any dirt or undesired elements are forced to flow with the well fluid 14 when being pumped back out through the outlet 4.

The second chamber 12 is filled with a second fluid which is cleaner than the well fluid 14, minimising the risk of dirt from the wellbore entering the vital parts of the pump 2. The second fluid is often a dielectric fluid also used in transformers and is therefore also called a "transformer fluid". The second liquid may be a mineral oil, castor oil, polychlorinated biphenyls (PCBs) or the like.

The pumping unit 8 comprises a one-way valve 15 arranged between the inlet 3 and the first chamber 11 and a second one-way valve 16 arranged between the outlet 4 and the first chamber 12. The one-way valves 15, 16 are shown as balls in a ball set but could be any suitable one-way valve. This means that when the moving member 9 is forced away from the inlet 3, thereby increasing the volume of the first chamber 11, the well fluid 14 fills the first chamber 11, but when the moving member 9 moves back towards the inlet 3, the fluid 14 is unable to flow back in through the inlet 3. The liquid 13 sucked into the first chamber 11 is subsequently forced out through the second one-way valve.

The moving members 9 are arranged so that when one moving member moves in one direction, another moving member moves in an opposite direction. This means that during one stroke, one piston is in its top position, and the other piston is in its bottom position. The volume V1 of the first chamber 11 of one pumping unit 8 is substantially the same as the volume V2 of the second chamber 12 of the other pumping unit. The top position is the position nearest to the inlet 3 and outlet 4, and the bottom position is the position furthest away from the inlet 3 and the outlet 4. In this way, the volume of the first chamber 11 of one pumping unit 8 is the same as the volume of the second chamber 12 of the other pumping unit. Hereby, one pumping unit feeds the other with the second fluid, ensuring that the "dirty" well fluid 14 is not sucked into the "clean" side of the pumping unit 8.

The wellbore pumping system 1 further comprises a compensator device 22, as shown in FIG. 3. The compensator device 22 comprises a compensator chamber 17 having a compensator moving member 18 acting like a piston displaceable in the compensator chamber 17 and dividing the compensator chamber into a first chamber section 19 and a second chamber section 20. The first chamber section 19 is in fluid communication with the well fluid 14 through an opening 23 in the wall of the chamber and through an opening 24 in the wall of the wellbore pumping system 1. The second chamber 12 of the pump is in fluid communication with the cavity 21 surrounding the housing 10 of the pumping units 8 and with the second chamber section 20. In this way, the well fluid 14 presses on the dirty side of the compensator moving member 18, equalising the pressure inside the pump 2 to be equal to the wellbore pressure P.

By having a compensator device 22, the loss of fluid due to leakage is less than for e.g. known pumps used downhole. Furthermore, the system is more energy-efficient, also in relation to liquids such as oil and water.

The compensator chamber 17 is thus a separate chamber from the cavity 21, and only the second chamber section 20 is in fluid communication with the cavity 21 through an orifice 40.

A screen or filter 30 is arranged in the openings 24 so that scales or other particles cannot enter the compensator device 22 or the pump 2 and deteriorate their function.

The compensator moving member 18 is displaceable inside the compensator chamber 17, and due to a circumferential sealing means 36, such as an O-ring, arranged between the compensator moving member 18 and the inside wall of the compensator chamber 17, the dirty well fluid is not mixed with the clean second fluid inside the pump 2. The compensator moving member 18 is arranged in a sliding relationship with two sliding rods 25. In this way, the compensator moving member 18 does not tilt while moving inside the compensator chamber 17 and furthermore, the compensator moving member 18 is a piston.

On the dirty side of the compensator moving member 18, where the well fluid 14 is, flexible elements 34, such as springs, are arranged around the rods 25 so that the fluid in the cavity 21 surrounding the housings 10 of the pumping units 8 has a higher pressure than that of the well fluid 14. This ensures that the well fluid 14 does not enter the cavity 21. This is especially useful if the well fluid 14 is very aggressive. Thus, the compensator device 22 comprises at least one flexible element 34 arranged in the first chamber section 19 forcing the compensator moving member 18 towards the pump 2.

In order to move the pistons in the housing 10, the driving unit 6 rotates a drive shaft 26 on which cams 27 are arranged for forcing a piston rod 28 of the piston up and down or back and forward. Thus, the rotating cam 27 is connected with the first moving member 9 producing reciprocating motion and the piston rod 28 functions as the cam follower.

The flow paths connecting the openings 24 of the pumping system 1 and the inlets of the pumping units 8 may be hollow spaces or drilled bores on the side of the pumping system 1, or a combination thereof. The drive shaft 26 penetrates the wall between the pump 2 and the driving unit 6 and is arranged with a sealing arrangement ensuring that the fluid surrounding the driving unit 6, such as a motor, is not mixed with the second fluid. The fluid inside and/or surrounding the motor may be the same as the second fluid, meaning that leaks in the transition between the pump and the driving unit around the drive shaft do not affect the function of the motor or the pump.

Figure 4:
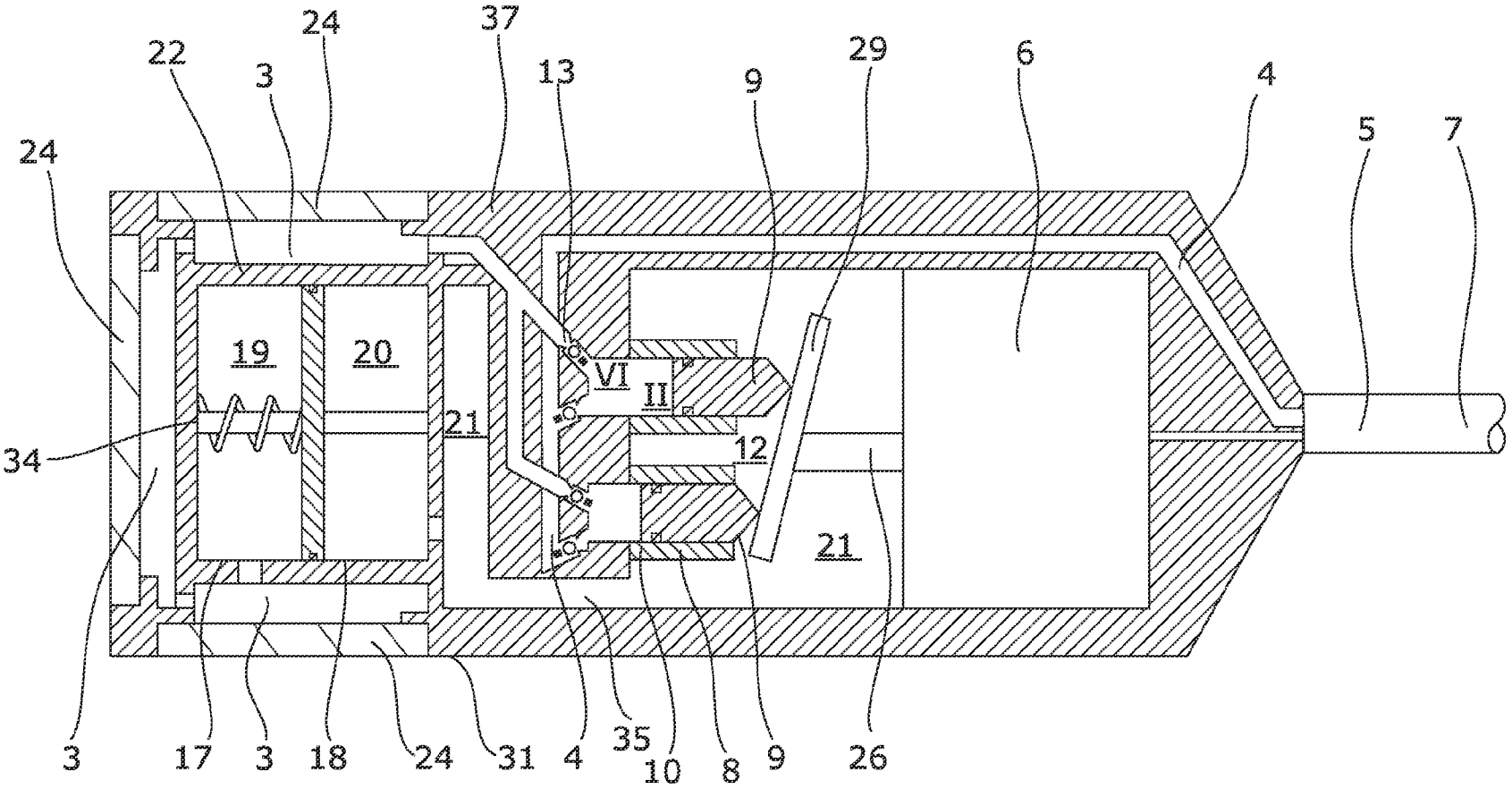
FIG. 4 shows a partly cross-sectional view along the longitudinal direction of the system of another embodiment of the wellbore pumping system All the figures are highly schematic and not necessarily to scale, and they show only those parts which are necessary in order to elucidate the invention, other parts being omitted or merely suggested.

As shown in FIGS. 3 and 4, the drive shaft 26 drives several pumps 2 and thus, the drive shaft is connected with several cams 27 interacting with several pistons so that when one piston moves away from the inlet 3 sucking fluid into the first chamber 11, another piston moves towards the inlet 3 equalising the volume of fluid in the second chamber 12. Hereby, the amount of fluid in the cavity 21 is substantially unchanged. However, some fluid in the cavity may leak through the first moving member 9 or piston but since the compensator device 22 applies a certain fluid pressure corresponding to the spring 34, dirty well fluid is not let into the cavity 21. Thus, the fluid inside the cavity may be sloshed around. However, the position of the compensator moving member 18 is substantially the same during the pumping procedure.

The system 1 may have more than two pump units 8 driven by the same drive means, and the three or more pump units may, in the same way as two pump units, equalise each other, e.g. when having three pump units, two moving members may move in one direction and the third in the other direction. The pump units may vary in displaced volume.

In FIGS. 3 and 4, the channels leading up to inlet 3 and away from outlet 4 are not in the same cross-sectional plane, but the outlet channel 4 is merely shown as a dotted line for illustration purposes only.

In FIG. 4, the pump 2 is an axial piston pump comprising two pumping units 8. Each pumping unit 8 has a first moving member 9 displaceable in a housing 10 for sucking well fluid 14 into and out of the first chamber 11. In this embodiment, the moving member 9 is a piston connected to a cam in the form of an inclined plate 29 which is rotated by the drive shaft 26 of the driving unit 6. When a piston 9 is retracted towards the driving unit 6 in the housing 10, the volume V1 of the first chamber 11 is increased, and well fluid 14 is sucked into the chamber. Subsequently, the well fluid 14 is forced out through the outlets 4 and into the tubing 5 when the piston moves towards the outlet 4.

In FIG. 4, the second chamber 12 of the pump housing 10 is also the cavity 21. The cavity 21 is thus in fluid communication with the rest of cavity 21 by a channel 35.

The compensator device 22 has the same design as the compensator device in FIG. 3, but has one sliding rod 25 instead of two.

As can be seen from FIGS. 3 and 4, the pumping system 1 has several openings for letting well fluid 14 into the pump 2. The system 1 may have openings 24 in one end of the system 1 as well as along its sides 31. By having openings in the wall of the pumping system both at the end of the system and along the sides, it is possible to use the wellbore pumping system 1 even though it is somewhat tilted and not in an upright position with its longitudinal axis parallel with the longitudinal axis of the wellbore.

The tubing 5 is used for pumping liquid 13, such as water, to above surface and is made of a non-metallic material, such as plastic, syntactic or natural rubber or a composite, making it possible to produce small diameter tubing which is flexible and does not fracture easily. Furthermore, having a flexible tubing ensures that even if the tubing is bent, it is still possible to pump liquid up through the tubing. The inner diameter of the tubing is 50-1 mm, preferably 30-5 mm and more preferably 20-5 mm. The tubing 5 may be in connection with the cable feeding power to the driving unit 6, e.g. in the form of an umbilical comprising both a fluid tubing and electrical cables.

When the tubing 5 is made of a material more flexible than iron or steel, making it possible to produce small diameter tubing, the pump 2 is also capable of pumping small amounts of fluid. A thin-walled reciprocating pump according to the present invention cannot pump the fluid all the way up to above surface if the diameter of the tubing 5 is too large since the pump 2 cannot not lift a liquid column having a large diameter, such as the diameter of a drill pipe or coiled tubing. The pumps made for drill pipes or coiled tubing are larger pumps designed for a substantially larger pumping capacity. The design of prior art pumps is therefore more complex and expensive. However, the pump 2 of the present invention has a simpler and less expensive design, meaning that a pump can be submerged for a longer time period of time and can be discarded when it is not functioning anymore. The driving unit 6 and the compensator device 22 may be reused, but may also be disposable, meaning that the entire wellbore pumping system may be a disposable system.

The amount of power needed for driving the pump 2 is estimated at less than 2 horsepower per day, preferably less than 1.5 horsepower if the well has a depth of 10,000 feet and accumulates a water rate of 10 barrels per day. If the pumping system 1 is submerged for a longer period of time for precautionary reasons, the pump 2 does not have to be as large as the known pumping systems which are submerged when production has stopped and need to pump up a large amount of water very quickly.

In another embodiment, the wellbore pumping system 1 has three pumping units 6, meaning that a first moving member 9 displaces a first volume V1 of liquid when moved in a first direction, and the two other moving members displace a second volume V2 of liquid when moved in the opposite direction of the first direction, wherein the first and the second volumes are substantially equal in size. When the first and the second volumes are substantially equal in size, the pumping system 1 does not need fixation devices to fixate the system in relation to the wellbore system since the movements of the moving members counterbalance or neutralise each other.

As shown in FIG. 1, the wellbore system 1 also comprises a control unit 32 for activating the pump 2. The control unit 32 is primarily arranged above surface, but part of it may be arranged in the part of the system being submerged into the wellbore. The control unit 32 sends a signal to the driving unit 6 to start or stop. The driving unit 6 comprises a starting means which during activation of the pump 2 reduces the torque delivered to a drive shaft 26 driving the pump 2. The control unit 32 furthermore comprises a means for controlling the driving unit 6 to reduce the torque delivered to the drive shaft 26. The starting means is also called "soft starters" and is primarily used in combination with AC electrical motors. Using a starting means performing a "soft" start eliminates the need for a fixation device for fixating the system in relation to the wellbore.

Known pumping systems using a fixation means for fixating the pumping system in relation to the wellbore are more complex in their design since the fixation means has to be unfolded when the system has been arranged at the bottom of the hole. If these known pumping systems are not fixated, they risk tilting when the pump starts, and the risk of a resulting malfunctioning pumping system thereby increases substantially.

Also, the control unit 32 may have a measuring unit 33 for measuring the power used by the driving unit 6 for driving the pump 2. If the measurements of the measuring unit 33 show that the driving unit 6 uses less power than a predetermined value, the pump 2 is stopped again. The value is higher than the amount of power used by the driving unit 6 for driving a pump 2 when the pump pumps up no or only a small amount of liquid. This makes it possible to save power when no or only a small amount of liquid is present in the wellbore.

After stopping the driving unit 6, the system 1 waits a predetermined period of time period and then reactivates the pump 2, while measuring the power. When the system has activated the pump 2 accordingly at the predetermined time interval a predetermined number of times, and the power is still not higher than the predetermined value, the time interval is extended. In this way, the measuring means is used for detecting the level of energy consumption during the pumping activity, and the control unit 32 controls the driving unit 6 based on the measured power. Hereby, the wellbore pumping system 1 does not consume any more energy than required for pumping up the liquid and is thus more environmentally friendly.

If the level of energy consumption during the pumping activity is still lower than the predetermined value after a predetermined number of activation attempts, the period of time from activation to activation is increased once again. The time period is between 5 minutes and 1 month, preferably between 5 minutes and 2 weeks and more preferably between 10 minutes and 1 week.

When in use, the wellbore pumping system 1 is entered into the wellbore, and when in place, the pump 2 is activated by sending a start signal to the driving unit 6 to activate the pump. Subsequently, the measuring unit 33 measures the power or level of energy consumption used by the driving unit 6 for driving the pump 2. The control unit 32 determines whether the power is higher than a predetermined value and if it is not, the pump 2 is stopped again. After a predetermined period of time, the pump 2 is reactivated, and the power is measured again. If the power is lower than a predetermined value, the pump 2 is stopped again. This start and stop procedure is repeated a predetermined number of times, and then the time period is prolonged. The start and stop procedure may be repeated 3-30 times, preferably 5-20 times and more preferably 5-10 times when the power consumption is lower than the predetermined value. The number of repetitions performed before increasing the time period may vary depending on the time period.

In order to be able to determine when to start and stop the driving unit 6, the control unit 32 comprises a receiving means for receiving the level of energy consumption X or power required for driving the pump 2 and a calculator unit for comparing the consumption with a predetermined minor value.

As shown, the reciprocating pump may be a piston pump, but may also be a diaphragm pump or a plunger pump.

A screen 30 or similar filter device may be placed in front of or as an integrated part of the inlet 3. It may also be arranged inside the walls of the pumping system 1, e.g. in a system housing, so that fluid entering several openings 24 has to flow through the same screen or filter device.

The wellbore pumping system 1 may comprise a fixation means for fixating the pump 2 in the wellbore, e.g. if the driving unit 6 does not have a starting means capable of performing a so-called "soft start".

The driving unit 6 may be any kind of means capable of driving the pump 2. Thus, the driving unit 6 may be an electrical motor or a hydraulic motor.

The driving unit 6 may also comprise a compensator device ensuring that the driving unit does not collapse or bulge outwards. Furthermore, if the driving unit 6 is compensated in the same way as the wellbore pumping system 1, the second fluid surrounding the pump 2 will not penetrate the transition between the pump and the driving unit where the drive shaft 26 of the driving unit enters the pump. Nor will the fluid inside the driving unit 6 mix with the second fluid in the pump 2, since the pressures inside the pump and the driving unit are equal.

By fluid or well fluid 14 is meant any kind of fluid which may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the system is not submergible all the way into the casing, a downhole tractor can be used to push the system all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A wellbore pumping system (1) submersible into a wellbore for unloading liquid (13) from a wellbore comprising well fluid (14), such as gas, having a wellbore pressure, comprising:

a pump (2) having an inlet (3) and an outlet (4), a tubing (5) fluidly connected with the outlet of the pump, and a driving unit (6) connected with and powered by a cable (7), and having a rotatable drive shaft (26) for driving the pump, wherein the pump is a reciprocating pump comprising at least one pumping unit (8) having a first moving member (9) displaceable in a housing (10) for sucking well fluid into and out of a first chamber (11), the system further comprising a compensator device (22) comprising a compensator chamber (17) having a compensator moving member (18) displaceable in the compensator chamber and dividing the compensator chamber into a first chamber section (19) and a second chamber section (20), wherein the first chamber section is in fluid communication with the well fluid.

2. A wellbore pumping system according to claim 1, wherein the first moving member divides the housing into the first chamber and a second chamber (12).

3. A wellbore pumping system according to claim 2, wherein the second chamber of the reciprocating pump is in fluid communication with the second chamber section.

4. A wellbore pumping system according to claim 1, wherein the system comprises a one-way valve (15) arranged between the inlet and the first chamber, and a second one-way valve (16) arranged between the outlet and the first chamber, enabling liquid to be sucked into the first chamber and subsequently forced out through the second one-way valve by displacing the moving member.

5. A wellbore pumping system according to claim 1, wherein the compensator moving member is a piston.

6. A wellbore pumping system according to claim 1, wherein the compensator device comprises at least one flexible element (34) arranged in the first chamber section forcing the compensator moving member towards the pump.

7. A wellbore pumping system according to claim 1, wherein the compensator moving member has a circumferential sealing means (36).

8. A wellbore pumping system according to claim 1, wherein the system has a system housing (37) having openings (24) into which a screen or filter (30) is arranged, preventing scales or other particles from entering the compensator device (22) or the pump (2) and deteriorating their function.

9. A wellbore pumping system according claim 2, wherein the first chamber is filled with liquid during pumping of the liquid, such as water, and the second chamber is filled with a second liquid.

10. A wellbore pumping system according to claim 9, wherein the second liquid is a dielectric fluid.

11. A wellbore pumping system according to claim 1, wherein the tubing is made from a non-metallic material.

12. A wellbore pumping system according to claim 9, wherein the pumping unit is surrounded by a cavity (21) filled with the second liquid and is in fluid communication with the second chamber of the pumping unit.

13. A wellbore pumping system according to claim 1, wherein the pump has a plurality of pumping units, and wherein the moving members are arranged so that when one moving member moves in one direction, another moving member moves in an opposite direction.

14. A wellbore pumping system according to claim 1, wherein a first moving member displaces a first volume (V1) of liquid when moved in one direction, and a second moving member displaces a second volume (V2) of liquid when moved in another direction opposite the first direction, wherein the first and the second volumes are substantially equal in size.

15. A wellbore pumping system according to claim 1, further comprising a control unit (32) for activating the pump.

16. A wellbore pumping system according to claim 15, wherein the control unit has a measuring unit (33) for measuring the power used by the driving unit for driving the pump.

17. A wellbore pumping system according to claim 16, wherein the pump is activated when a predetermined period of time has passed since the last stop of the pump.

18. A wellbore pumping system according to claim 1, wherein the driving unit comprises a starting means which, during activation of the pump, reduces a torque delivered to the drive shaft driving the pump.

19. A wellbore pumping system according to claim 1, wherein the drive shaft is connected with rotating cams (27) connected with the first moving member producing reciprocating motion.

20. A wellbore pumping system according to claim 1, wherein the drive shaft drives several pumps.

21. A wellbore pumping system according to claim 1, wherein the tubing has a cross-sectional width ($w_t$) being less than 25% of an inner diameter ($D_c$) of the wellbore or a casing in the wellbore.

22. A wellbore pumping system according to claim 1, wherein the cable comprises a wireline.

23. A wellbore pumping system according to claim 21, wherein the cross-sectional width is less than 10% of the inner diameter ($D_c$) of the wellbore or the casing in the wellbore.

24. A wellbore pumping system according to claim 21, wherein the cross-sectional width is less than 10% of the inner diameter ($D_c$) of the wellbore or the casing in the wellbore.

25. A wellbore pumping system according to claim 10, wherein the second liquid is a dielectric fluid, such as mineral oil, castor oil, Polychlorinated biphenyls (PCBs), etc.

26. A method comprising the steps of:

entering a wellbore pumping system according to claim 1, activating the pump, measuring the power used by the driving unit for driving the pump, determining whether the power is higher than a predetermined value, and stopping the pump when the power is lower than the predetermined value.

27. A method according to claim 26, further comprising the step of:

reactivating the pump after a predetermined period of time.

* * * * *